United States Patent [19]

Farrell et al.

[11] 4,215,494

[45] Aug. 5, 1980

[54] AUTOMATIC LOCKING MECHANISM FOR VEHICULAR MOUNTED SNOWPLOW

[75] Inventors: Eugene A. Farrell, Fishers Landing; Louis L. Montante, Clayton, both of N.Y.

[73] Assignee: Frink Sno-Plows, Clayton, N.Y.

[21] Appl. No.: 969,243

[22] Filed: Dec. 13, 1978

[51] Int. Cl.[2] ..... E01H 5/04

[52] U.S. Cl. ..... 37/42 R; 172/805

[58] Field of Search ..... 37/41, 42 R, 42 VL, 37/50; 172/792, 805, 806

[56] References Cited

U.S. PATENT DOCUMENTS

| | | | |
|---|---|---|---|
| 1,195,271 | 8/1916 | Ruth | 37/42 VL |
| 2,225,614 | 12/1940 | Ball | 37/42 R |
| 2,792,650 | 5/1957 | Kenyon | 37/42 R |
| 2,854,766 | 10/1958 | Miller | 37/42 R |
| 3,012,345 | 12/1961 | Krueger | 37/42 R |
| 3,353,287 | 11/1967 | King | 37/50 |
| 3,355,825 | 12/1967 | Weeks | 37/42 R |
| 3,793,752 | 2/1974 | Snyder | 37/42 R |

*Primary Examiner*—E. H. Eickholt

*Attorney, Agent, or Firm*—Bruns & Jenney

[57] ABSTRACT

Apparatus for automatically locking the blade mechanism of a vehicular driven snowplow at a desired angular position in regard to the forward line of movement of the vehicle. The locking device is adapted to automatically release the blade mechanism when the blade is raised from a normal snow clearing or working position and to move back automatically into locking engagement when the blade mechanism is lowered into the same or a new angularly disposed working position.

8 Claims, 4 Drawing Figures

AUTOMATIC LOCKING MECHANISM FOR VEHICULAR MOUNTED SNOWPLOW

BACKGROUND OF THE INVENTION

This invention relates to a vehicular mounted plow for clearing snow or the like and, in particular, to a locking mechanism for automatically engaging an angularly adjustable blade mechanism when the mechanism is placed in a working or snow removal position and for releasing the blade when the assembly is lifted from the working position.

The most pertinent prior art known to the applicant at the time of filing this application is contained in the following U.S. Pat. Nos.:

1,195,271
2,251,452
2,792,656
2,854,766
3,012,345
3,353,287

As described by Kruger in the above-noted U.S. Pat. No. 3,012,345, many vehicular driven snowplows are equipped with locking devices for securing the blade mechanism of the plow at some desired angular position relative to the longitudinal axis of advance of the blade as typically described by the forward motion of the vehicle. Conventionally, the locking device is controlled by a hydraulic cylinder which serves to selectively position a reciprocating locking pin into one of a plurality of receiving holes formed in the main support frame of the plow assembly. It sometimes becomes difficult for the operator, who is remotely situated in the cab of the vehicle, to properly seat the locking pin in the appropriate receiving hole. When improperly aligned, the pin can be clamped against the top surface of the sector plate, rather than being seated in one of the receiving holes, thereby providing only a minimum amount of holding force against the blade. As a consequence, the blade, upon coming in contact with a relatively large mass of snow, may be rapidly rotated about the support frame of the plow thereby creating a potentially dangerous situation.

In operation, most snowplow blades are initially lifted in a vertical direction some distance above the roadbed before the blade is angularly moved to a new working position. Typically, the lifting, repositioning, and blade locking functions are individually controlled, thus requiring that the operator perform the operations in an ordered sequence in order to avoid damaging the equipment. For example, if the lifted blade is angularly repositioned before the locking pin is removed, the pin will usually be bent and/or the hydraulic system damaged thereby rendering the plow inoperative.

SUMMARY OF THE INVENTION

It is therefore an objective of the present invention to improve remotely operated snowplow assemblies that are utilized in conjunction with motorized vehicles.

A further object of the present invention is to provide an automatically operated blade-locking device containing a resiliently mounted locking bar having sufficient flexibility to enable the bar to seat itself in a receiving hole in the event the bar is misaligned with the hole.

Another object of the present invention is to provide a blade-locking mechanism that will automatically release the blade of a snowplow when the blade is raised from a normal snow-clearing position and to actively engage the blade when it is again lowered into a working position.

Yet another object of the present invention is to provide a rugged yet inexpensive automatically operated blade-locking mechanism for use in conjunction with remotely controlled vehicular-mounted snowplows.

These and other objects of the present invention are attained by means of a snowplow assembly suitable for attachment to a motor vehicle which includes a vertically movable support frame for raising and lowering the plow assembly, a blade mechanism pivotally mounted within the frame for angularly adjusting the position of the blade, a sector plate having spaced-apart slotted holes formed therein securely mounted upon the frame, a locking bar pivotally mounted within the blade mechanism that is arranged to be moved between a first plate-engaging position wherein the bar is selectively seated within one of the holes formed therein and a second plate-releasing position wherein the bar is removed from seating engagement with the plate, and actuating means for automatically urging the locking bar into the first plate-engaging position when the blade is in a snow-clearing position and to automatically place the locking bar in a second plate-releasing position when the blade is raised from the snow-clearing position.

A BRIEF DESCRIPTION OF THE DRAWINGS

For a better understanding of these and other objects of the present invention reference is had to the following detailed description which is to be read in conjunction with the following drawings, wherein.

DESCRIPTION OF THE INVENTION

Figure 1:
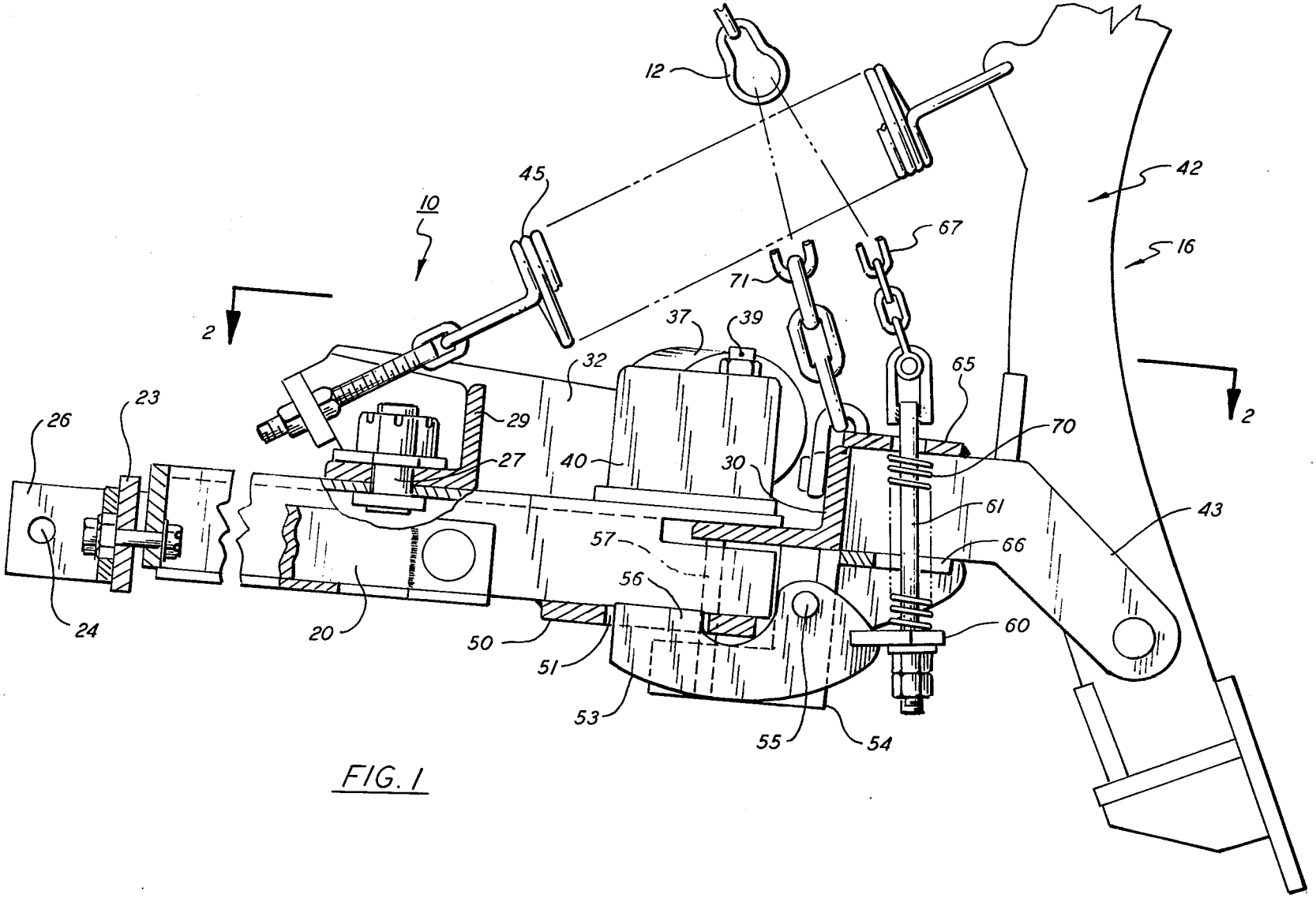
FIG. 1 is a partial side elevation in section showing snowplow embodying the teachings of the present invention.
Figure 2:
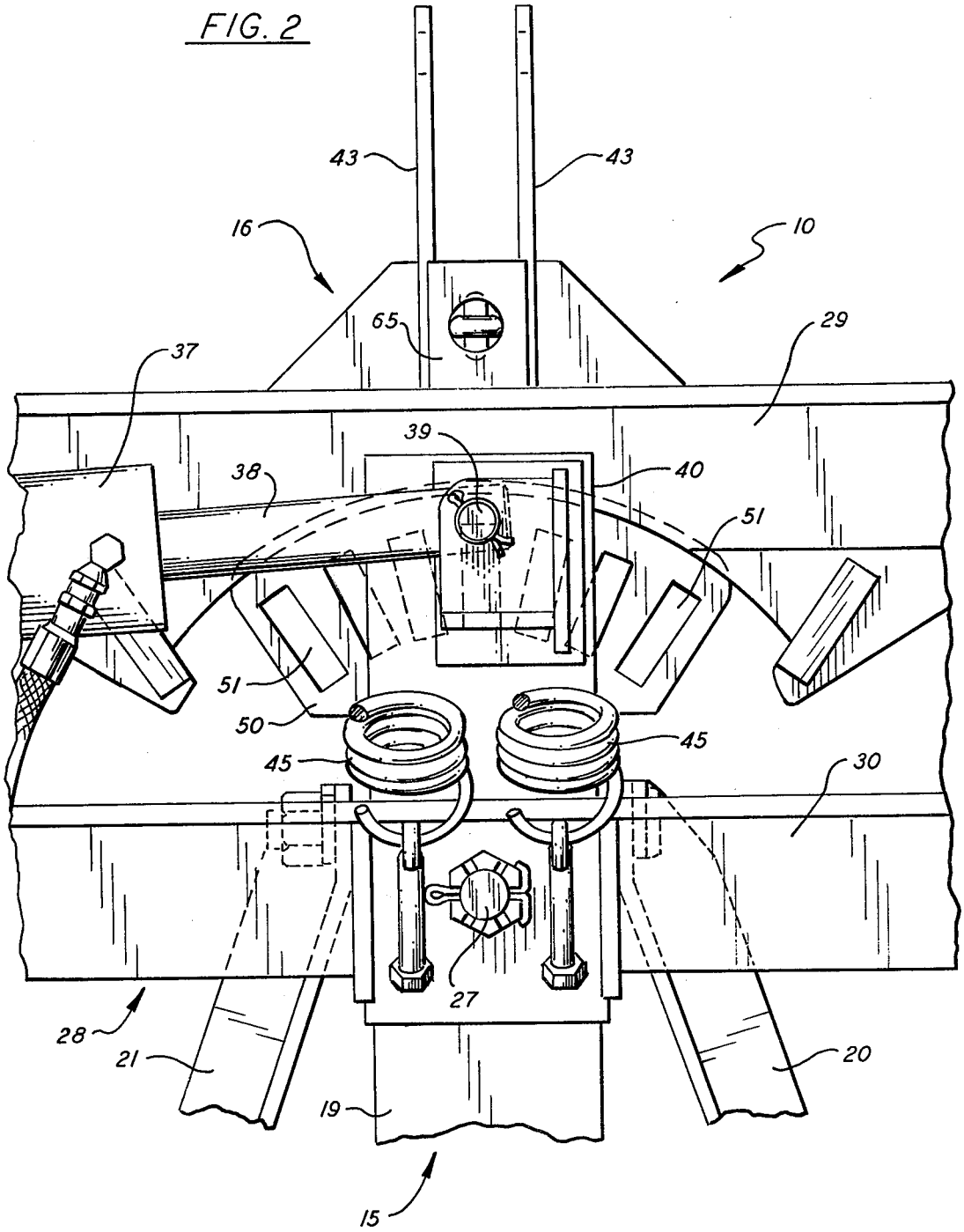
FIG. 2 is a partial top plan view taken along lines 2—2 of FIG. 1.

As best seen in FIGS. 1 and 2 the snowplow, generally referenced 10, embodying the present invention is adapted to be mounted upon the front end of a truck or the like in a conventional manner such as that described in the previously noted U.S. Pat. No. 2,792,656. Although not shown it should be understood that the truck is provided with an upright pusher bracket secured to the front of the vehicle and which is adapted to push the snowplow assembly 10 before the vehicle along a generally longitudinal path of travel. A remotely controlled, hydraulically-driven, lifting arm is mounted upon the bracket and is connected to the plow by means of chains to enable the plow assembly to be raised in a generally vertical direction from its normal snow-clearing position. In practice, the lifting chains are secured to the lifting arm via a shackle 12.

Figure 3:
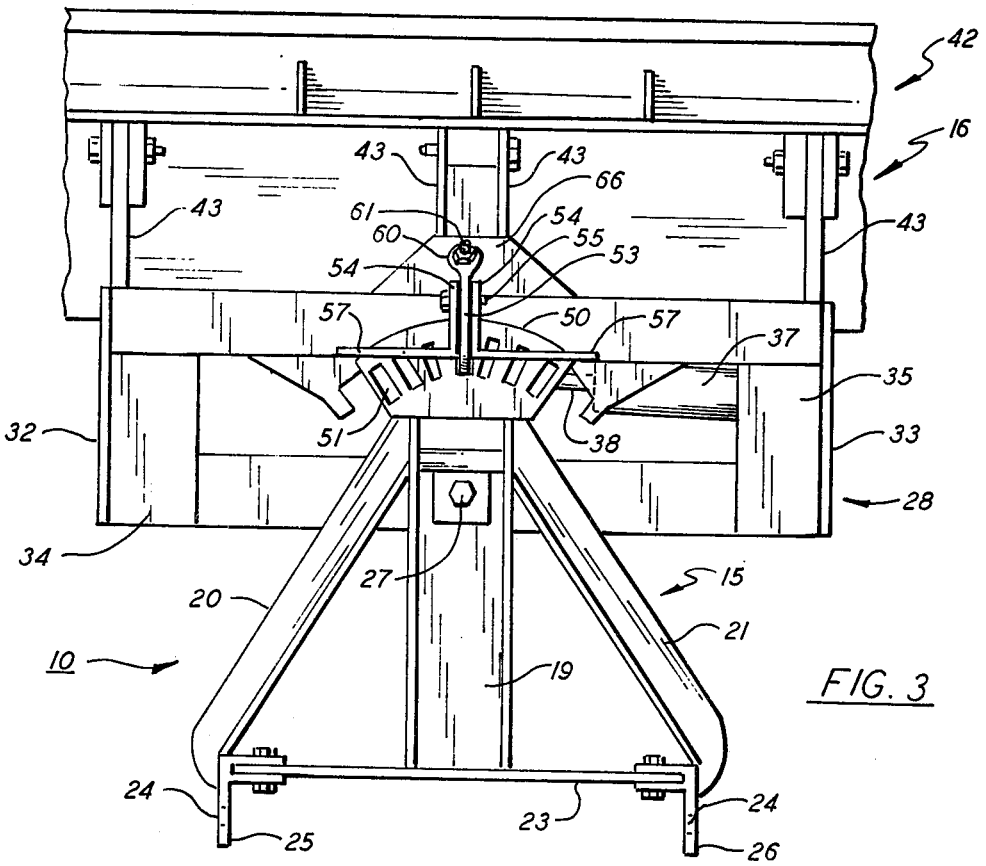
FIGS. 3 and 4 are slightly reduced bottom plan views of the apparatus illustrated in FIG. 1 further showing the blade of the snowplow angularly disposed in different snow clearing positions.
Figure 4:
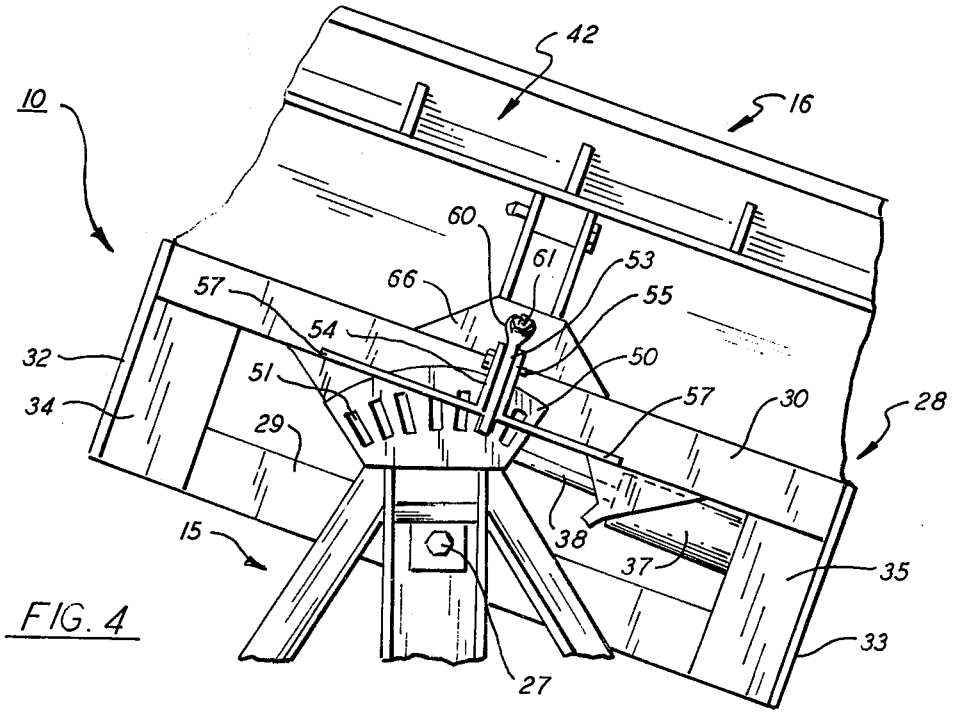

With further reference to FIGS. 3 and 4, the plow assembly is made up of two main sections which are a horizontally-extended frame 15 and a generally laterally-extended adjustable blade mechanism 16, which is rotatably supported in the frame.

The frame section further includes a centrally located main drive channel 19 having two obliquely positioned drive bars 20, 21 bolted to the distal end thereof. The proximal end of the main channel and the two free ends of the drive bars are locked together by means of a longitudinally extended equalizing bar 23. In assembly, the frame is pivotally attached to the previously-noted truck-mounting pusher bracket by means of a pair of pins (not shown) that pass horizontally through aligned pivot holes 24 formed in the two extended flanges 25, 26 depending rearwardly from the frame. As will be described in further detail below, the frame, through means of the horizontally aligned pivots, is adapted to vertically lift the entire plow assembly and thus elevate the blade above its normal snow-clearing or working position. Typically, as is well known in the art, a pair of skids or shoes are mounted on the outboard ends of the mould board assembly to locate the blade at the desired working position.

The blade-adjusting section 16 is pivotally supported in the distal end of the drive channel 19 by means of a vertically aligned pivot bolt 27 (FIG. 1). The blade mechanism includes a laterally extended structure 28 that includes two horizontally extended angle irons which are identified as rear angle iron 29 and front angle iron 30 in the drawings. The angle irons are welded to two end plates 32, 33 to hold the two angles in parallel alignment. To provide further strength to the weldment, reinforcing plates 34, 35 are also welded to the horizontally aligned legs of each angle. As best seen in FIG. 1, the shank of the pivot bolt 27 passes centrally through the horizontal leg of rear angle iron 29 and the web of drive channel 19 to enable the blade mechanism to swing in a horizontal plane about the frame whereby the blade is angularly adjusted in regard to the direction of motion of the truck.

A hydraulic cylinder 37 is pivotably mounted on horizontal plate 35 of the blade adjusting mechansim. The ram 38 or driving arm of the cylinder is connected to a swivel pin 39. The swivel pin passes through a hole formed in the outer end of the ram and is secured in a vertical position within swivel bracket 40. Bracket 40, in turn, is welded to the top surface of the main drive channel 19 whereby the cylinder acts between the frame and the blade mechanism. When the ram of the cylinder is hydraulically extended, the blade mechanism is caused to turn in one direction about the pivot 27. Reversing the hydraulics causes the ram to be retracted into the cylinder to turn the blade mechanism in the opposite direction.

Referring more specifically to FIG. 1, the moldboard 42 of the blade mechanism is secured to the welded support structure 28 by means of a plurality of forwardly extended drive ears 43—43. The moldboard is resiliently held in position by means of heavy duty trip springs 45 which are anchored in the rear angle iron 29 of the previously noted support structure. A pair of bridle chains 44—44 are secured in the vertically raised leg of the front angle 30 and brought upwardly to the previously noted lifting shackle 12. As previously noted the shackle is operatively connected to a hydraulically operated lifting bar which is provided in the main bracket mounted upon the truck. Under the influence of the lifting bar, the shackle exerts an equal pull on the two bridle chains to uniformly raise the blade of the plow from its normal working position.

A sector plate 50 is welded to the bottom of the drive channel 19 at the extreme outer edge thereof. The plate contains a series of spaced-apart, elongated slots or holes 51 which pass through the plate in a vertical direction. The holes are equally spaced along an arc having its center lying upon the center of pivot bolt 27.

A rocker arm 53, is pivotally mounted in the adjustable blade mechanism and is arranged to co-act with the sector plate to lock the blade mechanism in a preselected position in regard to the frame. The rocker arm, which is adapted to turn in a vertical plane, is suspended below front angle iron 30 between two L-shaped pivot ears 54—54 which are welded to the bottom surface of the angle in parallel alignment. The bar is hung upon a pivot pin 55 supported between the vertical legs of the two pivot ears whereby the locking bar 56 of the rocker arm can be moved into and out of seating engagement with the holes formed in the sector plate. The horizontal legs of each pivot ear extend outwardly over the bottom surface of the sector plate and serve to guide the locking bar of the rocker arm into the receiving holes. A longitudinal reinforcing bracket 57, having a cut-out for accommodating the sector plate, is welded to the bottom surface of the angle iron 30 and the outer sidewall of each pivot ear to provide both lateral stability and added strength to the locking mechanism.

A platform 60 depends outwardly from the main body of the rocker arm. A tensioning rod is cantilevered in a generally upright position from the platform 60 as shown in FIG. 1. The rod is adapted to pass upwardly through elongated holes provided in upper and lower gusset plates 65 and 66 that are secured to the front face of angle 30 and two centrally located drive ears. The extended end of the rod is secured to an actuating chain 67 which, in turn, is connected to the lifting shackle 12. A compression spring 70 encircles the shank of the tensioning rod and is arranged to act at a predetermined rate between the upper gusset plate 65 and the rocker arm platform. Under the biasing pressure of the spring, the rocker arm continuously drives the locking bar in a clockwise direction about the pivot pin 54 to urge the locking bar into seating engagement with an adjacent hole formed in the sector plate.

In assembly, the bridle chain 71 is allowed more slack than the actuating chain. Accordingly, when the plow is raised from its normal working position by the lifting shackle, the actuating chain will be tensioned before the bridle chains. The prematurely tensioned actuating chain, acting through the tensioning rod, causes the locking bar to be moved back into the sector plate releasing position as the lifting arm begins to raise the plow assembly. After the locking bar has been released, the lifting mechanism continues to raise the plow assembly to elevate the blade into a position wherein it can be angularly repositioned.

As can be seen, through this arrangement, the adjustable blade is automatically unlocked from the frame of the plow as the blade is raised from a snow-clearing position. As a consequence, the raised blade can be conveniently swung about the pivot bolt 27 to a new angular position without fear or danger of damaging the locking mechanism.

When the repositioned blade is again lowered into a snow-clearing position, the tensioning bolt is automatically released thus allowing the biasing spring to urge the locking bar into seating engagement within one of the sector plate holes. In the event that the locking bar is out of alignment with the receiving hole, the biasing spring arrangement provides sufficient flexibility or resilience to the system to enable the bar to be joggled into the receiving hole as the blade mechanism moves downwardly or bounces over the ground.

While this invention has been described with reference to the disclosure above, it is not necessarily limited to this particular structure and this application is intended to cover any modifications or changes that may come within the scope of the following claims.

We claim:

1. In a vehicle mounted snowplow of the type having a vertically movable support frame that is horizontally extended from the front of the vehicle, lifting means acting upon the frame for raising the blade of the plow above its normal snow clearing position and a blade adjusting means for horizontally positioning the blade which is pivotably supported in the frame for angularly positioning the blade in respect to the frame, the improvement comprising a sector plate having a series of spaced apart holes formed therein, said plate being secured to the frame of said plow a rocker arm being pivotably mounted in the blade adjusting means for moving a locking bar between a first plate engaging position wherein the bar is selectively seated within one of the holes formed in said plate and a second plate releasing position wherein said bar is moved out of engagement with one of said holes, and actuating means for automatically urging the locking bar into said first plate engaging position when the frame is supporting the blade in a snow clearing position and for automatically moving the locking bar into said second plate releasing position when the frame is raised to lift the blade from the snow clearing position.

2. The snowplow of claim 1 that further includes a vertically aligned pivot pin for pivotably supporting the blade adjusting means in the frame, and wherein the holes formed in the sector plate are equally spaced along an arc whose center lies substantially upon the vertical axis of the pivot pin.

3. The snowplow of claim 1 wherein said blade actuating means further includes a push rod that is secured at one end to said rocker arm and is operatively connected at the other end to said lifting means so that said rod causes the locking bar to be moved into said second position when it is raised by said lifting means.

4. The snowplow of claim 3 further including a compression spring wound about said rod, the spring being adapted to act against the rocker arm to urge said bar into a first plate engaging position and whose biasing force is overcome by the rod as said rod is raised by said lifting means.

5. A snowplow having a blade including a support frame adapted to be attached to the front of a vehicle, said frame being movable in a vertical direction to raise the blade of the plow from its normal working position adjacent to the ground, a sector plate secured to the frame and having a series of spaced apart holes formed therein, a blade support assembly rotatably mounted in said frame for movement in a horizontal direction whereby said blade is angularly adjustable in regard to said frame, a rocker arm pivotably supported in said blade assembly to move a locking bar between a first position wherein the bar is seated in engagement within one of said holes formed in said sector plate and a second position wherein said bar is released from engagement with said sector plate, biasing means associated with said rocker arm for urging the bar into said first position, lifting means for raising the frame in a vertical direction, and actuating means being secured to the rocker arm that is operatively connected to said lifting means for moving the locking bar from said first position into said second position as the frame is raised and to return the bar into said first position as the frame is being lowered.

6. The snowplow of claim 5 which further includes a vertically aligned pivot pin that is arranged to pivotably support the blade assembly in the frame, and wherein the holes formed in the sector plate are equally spaced along an arc whose center lies substantially on the vertical axis of the pivot.

7. The snowplow of claim 5 wherein said lifting means includes at least one bridle chain secured to the blade assembly.

8. The snowplow of claim 7 wherein said actuating means includes a rocker arm actuating chain extending between the lifting means and the rocker arm and whose length is such that it is tensioned by the lifting means prior to the bridle chain being tensioned.

* * * * *